US005924255A

United States Patent [19]

Vagedes

[11] Patent Number: 5,924,255

[45] Date of Patent: Jul. 20, 1999

[54] SHUTTER ASSEMBLY

[75] Inventor: Michael Vagedes, Florence, Ky.

[73] Assignee: Richwood Building Products, Inc., Richwood, Ky.

[21] Appl. No.: 09/008,035

[22] Filed: Jan. 16, 1998

[51] Int. Cl.[6] ..... E06B 7/08

[52] U.S. Cl. ..... 52/473; 52/586.2; 403/331; 403/363; 403/383; 454/221

[58] Field of Search ..... 52/473, 586.2, 52/455, 456, 457, 458, 474, 302, 309.1, 314; 403/331, 363, 361; 454/221

[56] References Cited

U.S. PATENT DOCUMENTS

| | | | |
|---|---|---|---|
| 3,055,467 | 9/1962 | Peek et al. . | |
| 3,086,442 | 4/1963 | Waldron . | |
| 3,191,242 | 6/1965 | Rauen . | |
| 3,208,564 | 9/1965 | Sitterly . | |
| 3,455,079 | 7/1969 | Frederick . | |
| 3,609,928 | 10/1971 | Mock . | |
| 3,797,186 | 3/1974 | Smith . | |
| 3,802,146 | 4/1974 | Tacke et al. . | |
| 3,936,985 | 2/1976 | Marulli . | |
| 3,956,861 | 5/1976 | Rasmussen . | |
| 3,968,738 | 7/1976 | Matzke . | |
| 3,991,537 | 11/1976 | Brown . | |
| 4,251,966 | 2/1981 | Foltman . | |
| 4,330,972 | 5/1982 | Sailor . | |
| 4,381,633 | 5/1983 | MacLeod . | |
| 4,566,236 | 1/1986 | Pound . | |
| 4,765,110 | 8/1988 | MacLeod . | |
| 5,060,442 | 10/1991 | Chubb . | |
| 5,088,255 | 2/1992 | Emanuel . | |
| 5,152,116 | 10/1992 | MacGowan . | |
| 5,163,260 | 11/1992 | Ricard et al. . | |
| 5,222,343 | 6/1993 | Anderson . | |
| 5,230,180 | 7/1993 | Tweedt et al. . | |
| 5,265,391 | 11/1993 | Ricard et al. . | |
| 5,353,571 | 10/1994 | Berdan et al. . | |
| 5,373,677 | 12/1994 | Vagedes | 52/473 |
| 5,412,909 | 5/1995 | Wu . | |
| 5,426,897 | 6/1995 | Gazaway . | |
| 5,430,986 | 7/1995 | Vagedes | 52/473 |
| 5,524,407 | 6/1996 | Ricard et al. . | |
| 5,553,652 | 9/1996 | Rushford . | |
| 5,617,688 | 4/1997 | Gandy et al. | 52/473 |
| 5,826,393 | 10/1998 | Wenzlaff et al. | 52/473 |

*Primary Examiner*—Christopher Kent
*Assistant Examiner*—Yvonne Horton-Richardson
*Attorney, Agent, or Firm*—Wood, Herron & Evans, L.L.P.

[57] ABSTRACT

A shutter assembly which includes separate top and bottom portions and intermediate slatted portions. The top and bottom portions both include right and left side flanges which include inner and outer channels. Likewise the slatted portion includes a right and left sides which include right and left channels which align with the inner channels on the top and bottom members. Right and left side rails snap fit into the three sections holding them together. The inner wall of the rails snap into the inner channels and the channel in the slatted portion. The inner walls of the side rails include upper arcuate lips that extend over the top edges of the side walls of the top, bottom and slatted sections. The outer wall of each rail includes an L-shaped projection which fits within the outer channels in the flanges. The shutter can be adjusted by removing sections of the slatted portions along pre-formed score lines and then cutting rails to the desired size. Shutters are then assembled and mounted to a building surface. The inner and outer channels prevent the flanges from spreading out, and standing ribs keep the rail from collapsing when screwing down, providing a natural appearance. The configuration of the inner channels facilitates the ease of assembly.

19 Claims, 4 Drawing Sheets

SHUTTER ASSEMBLY

BACKGROUND OF THE INVENTION

Ornamental plastic shutters are frequently fastened to an exterior house wall immediately on either side of a window. Window sizes, of course, vary significantly. Further, the plastic shutters are generally made in colors that match siding colors. Therefore, plastic shutters are made in a variety of different sizes and a variety of different colors. This requires a separate mold for each size and, of course, stocking the different sizes and different colors.

In the past there have been numerous attempts to provide shutters that can be cut to a desired size and assembled. For example, Foltman U.S. Pat. No. 4,251,966 discloses a shutter which includes separate slat portions, body portions and end rails that can be cut to a desired size and assembled with screws. Likewise, McGowan U.S. Pat. No. 5,152,116 and Chubb U.S. Pat. No. 5,060,442 disclose such types of assembled shutters. The problem with these shutters is they require a lot of work to assemble and further, the pieces of the assembled shutters do not form a tightly assembled shutter.

Another problem associated with the Foltman design is that the slat portions and body portions slide together in a channel that runs along right and left side rails. It is very difficult to slide the individual portions of the shutter through the channels. If the channels are enlarged to make it easier to assemble, the shutter becomes loose and aesthetically less appealing.

One solution to this problem is disclosed in Vagedes U.S. Pat. Nos. 5,373,677 and 5,430,986 and Gandy U.S. Pat. No. 5,617,688 which disclose end caps which fit over the upper and lower edges of the shutter. The shutter is simply cut to a size and the end caps placed over it. Thus the side rails, slats and body portions are all formed from one piece with the upper and bottom caps formed separately. In this embodiment, however, the end caps must fit over the top and bottom of the shutter which in certain circumstances may not provide the desired appearance.

SUMMARY OF THE INVENTION

Accordingly, it is an object of the present invention to provide a shutter which can be adjusted in size and assembled. Further, it is an object of the present invention to provide such a shutter which is easy to assemble and yet forms a very strong, tightly assembled shutter.

These objects are achieved by providing a shutter that has a top and bottom member and an intermediate slat member that are held together by left and right side rails. The top and bottom members both have left and right flanges which have an inner and outer channel. The rails, in turn, have an inner wall that snap fits from the back into the inner channel where it locks into position. Further, the side rail has an outer wall which includes an inward "L"-shaped extension which in turn snaps into the outer channels of the flanges. This permits the individual pieces to be snap fitted together since inner and outer channels are used. The side rails are held in the desired configuration and do not bend in or out when the shutter is hung. The shutter can be adjusted by simply cutting the size of the rails and cutting the slat portion.

Further, the rails include an inwardly extended lip that fits over the left and right side walls respectively of the top portion, bottom portion and slat portion which further holds the assembly together and provides an improved aesthetic appearance.

Other objects and advantages of the present invention will be further appreciated in light of the following detailed description and drawings in which:

DETAILED DESCRIPTION

Figure 1:
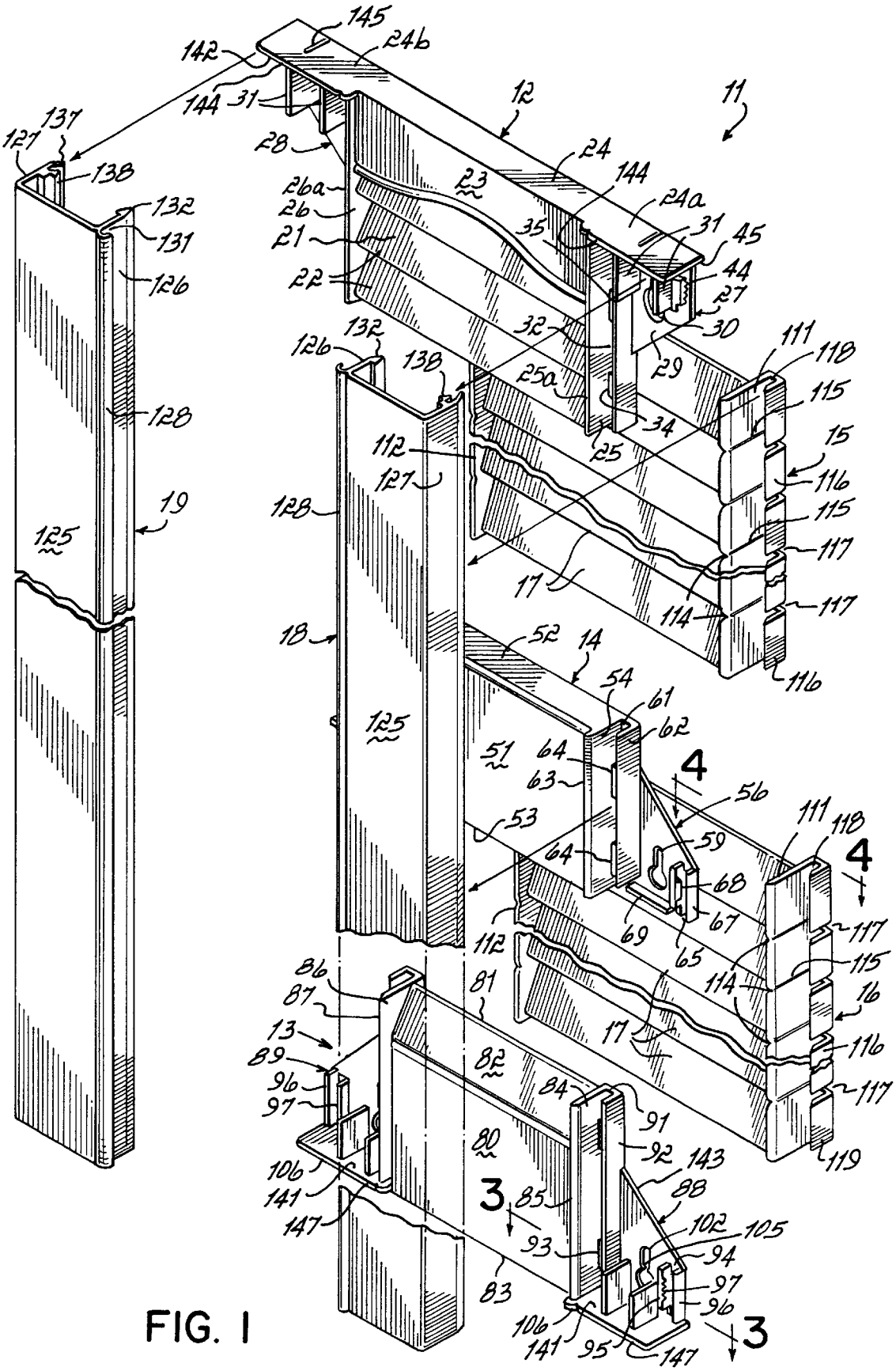
FIG. 1 is an exploded view of a shutter according to the present invention.
Figure 2:
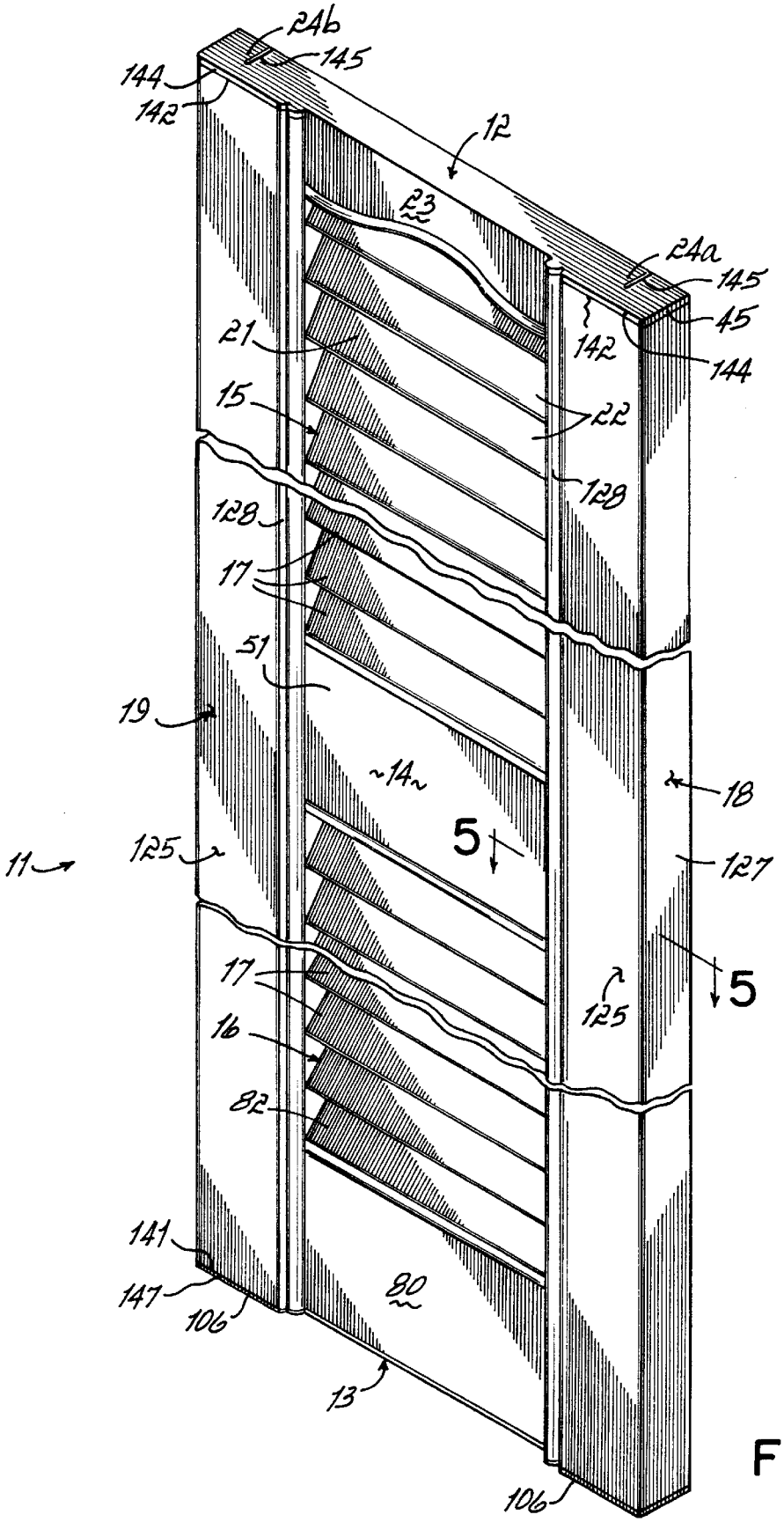
FIG. 2 is a perspective view of the shutter of the present in an assembled configuration invention.

As shown in FIGS. 1 and 2, the present invention is a shutter assembly 11 which includes a top portion 12, a bottom portion 13, and a middle portion 14. Separating the top portion 12 from the middle portion 14 and the middle portion 14 from the bottom portion 13 are first and second shutter body or slatted portions 15 and 16 which are formed from a plurality of individual slats 17. Holding the top, bottom, middle and body portions together are right and left rails 18 and 19 as will be explained further.

Figure 6:
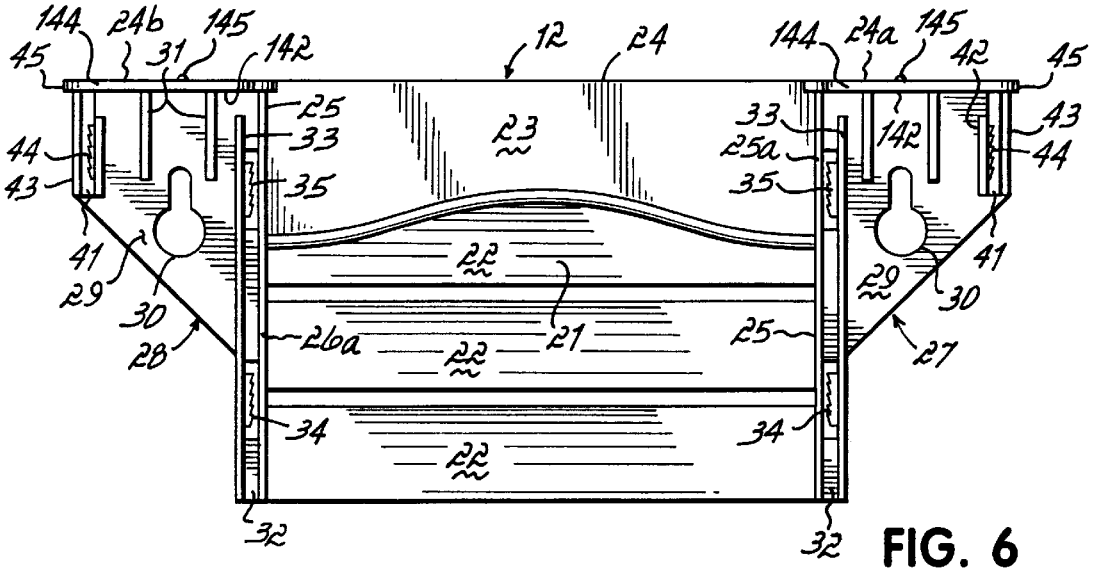
FIG. 6 is a front view of the top portion of a shutter according to the present invention.

As shown in FIG. 6, the top portion itself 12 includes a front 21 which includes one or more slats 22 and an upper portion 23. There is a top surface 24 which forms the upper edge surface of the shutter. The top portion 12 also includes right and left side walls 25 and 26. Each side wall has a ridge 25*a* and 26*a* which extend above body 21. Portion 24*a* and 24*b* of the top surface 24 extends laterally beyond the front 21 extending beyond right and left side walls 25, 26. Below portions 24*a* and 24*b* are right and left flanges 27 and 28 respectively. The right and left flanges 27 and 28 are mirror images of each other and accordingly, only the right flange 27 will be described with like numbers used on corresponding elements for the right and left flange respectively.

The right flange 27 includes a central portion 29 which includes a keyhole shaped opening 30 which acts as a mounting hole for the shutter. Adjacent the right side wall 25 is an inner channel 32 which is formed between the right side wall of 25 and an inner wall 33. A plurality of toothed detents or projections 34 and 35 are located on inner wall 33.

The right flange 27 further includes an outer channel 41 which is formed from a first wall 42 and second wall 43. The first wall includes a detent 44 which includes a plurality of teeth. The second wall 43 is even with the furthest outer edge 45 of the top wall 24. Two rectangular ribs or tabs 31 are fixed to each of flanges 27 and 28 and to portion 24*a* and 24*b* of top wall 24. Ribs 31 provide added rigidity to portion 24*a* and 24*b* and allows the rail to sit flush with edge of 45.

Figure 7:
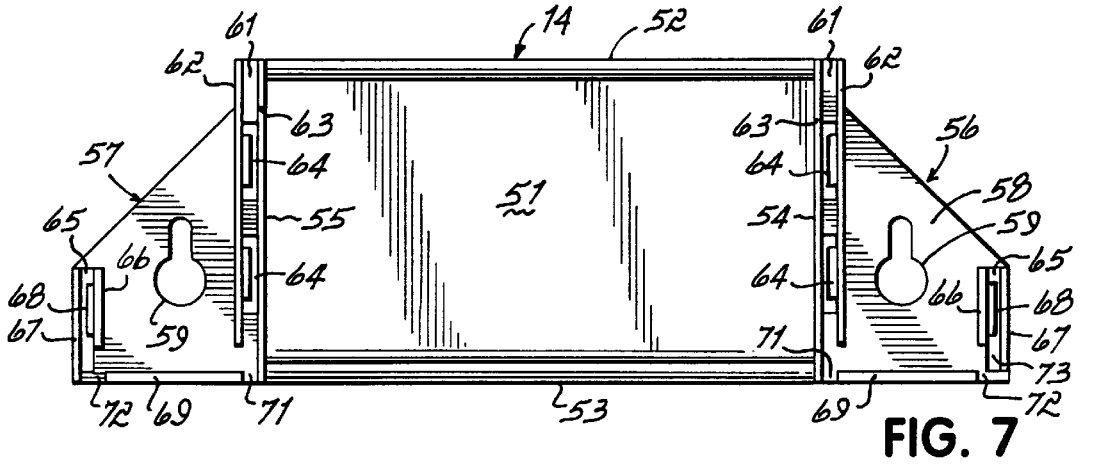
FIG. 7 is a front view of a middle portion of a shutter formed according to the present invention.
Figure 8:
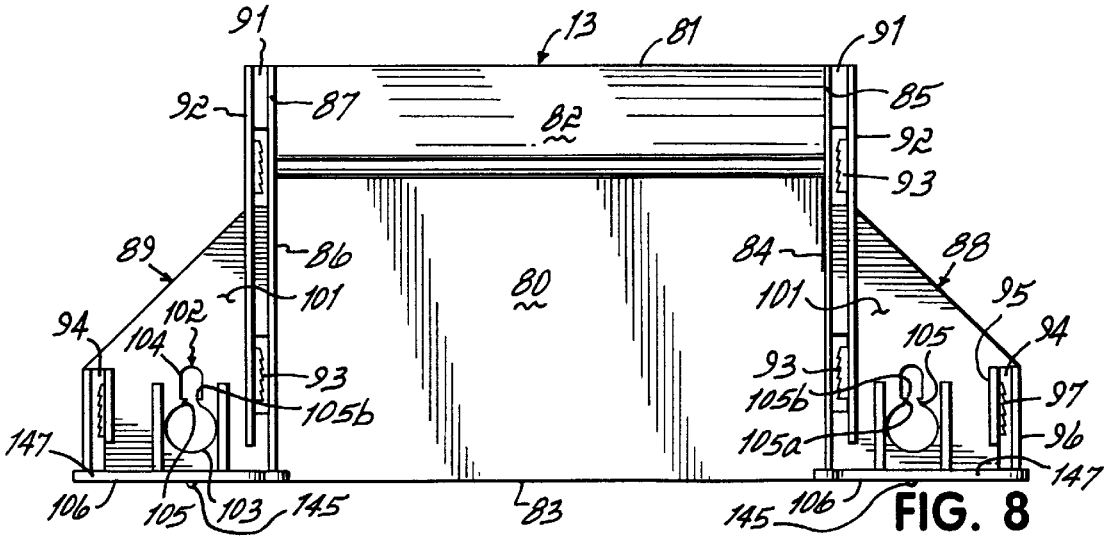
FIG. 8 is a front view of a bottom portion of a shutter.

Middle or central portion 14 further includes a body portion 51, a top edge 52, a bottom edge 53 and right and left side walls 54 and 55. Extended from side walls 54 and 55 are right and left flanges 56 and 57. These are mirror images of each other and accordingly, only the right flange 56 is discussed with corresponding numbers used on both the right and left flange. The flange 56 includes a central portion 58 which has a keyhole opening 59 extended there through. The upper edge 63 of wall 54 extends slightly above the body 51 of central portion 14. An inner channel 61 is formed from the side wall 54 and an outer wall 62 (FIG. 1 and 7) Outer wall 62 has a height which is less than the height of the wall 54. Outer wall 62 further includes a plurality of inward projections or detents 64.

The outer edge of flange 56 further includes an outer channel 65 which is formed between first and second walls 66 and 67. The first wall 66 includes detent 68.

The bottom edge of flange 56 further includes a bottom projection 69 which runs parallel with the bottom edge of the central portion 14. This projection extends from the inner wall 62 towards the second strip 67 leaving a space between second strip 67 and the bottom projection 69. This provides three openings 71, 72 and 73 along the bottom of the flange 56 which facilitate location of certain portions of the rails as is explained below.

As shown in FIGS. 1, 3, 3A and 8, the bottom section 13 is similar to the top section 12. Bottom section 13 includes a body portion 80, a top edge 81 with a simulated slat 82. Further, bottom 13 includes a bottom surface 83. The body 80 of bottom portion 13 includes a right side wall 84 having an upper edge 85 and a left side wall 86 also having an upper edge 87. Extended from the right and left side walls 84, 86 are right and left flanges 88 and 89. These are mirror images of each other and again only the right flange 88 is described again with like numbers used on the corresponding left flange.

Adjacent the right side wall 84 is a channel 91 which is formed from the right side wall 84 and wall 92. The inner wall 92 has a height significantly less than the height of the right side wall 84. Wall 92 includes two inwardly projecting toothed detents 93 which extend towards the side wall 84. Flange 88 further includes an outer channel 94 which is formed from an inner and outer strips 95 and 96. Inner strip 95 includes a serrated detent 97 which points towards the outer strip 96.

The flange 88 further includes a central body 101 which includes a keyhole opening 102. This keyhole opening has a large round portion 103 and a narrow upper portion 104. Separating the large portion and the narrow portion are projections 105, which will help maintain the shutter assembled as described hereinafter. The lower surface 105*a* of projection 105 are tapered whereas the upper surface 105*b* juts inwardly providing a stop. At the bottom of flange 88 is a stop member or bottom wall 106.

Separating the top, middle and bottom sections are slatted portions 15 and 16 respectively. These sections are identical. Optionally, the middle section 14 can be eliminated and the shutter formed from a top and bottom separated by only one slatted portion.

Figure 4:
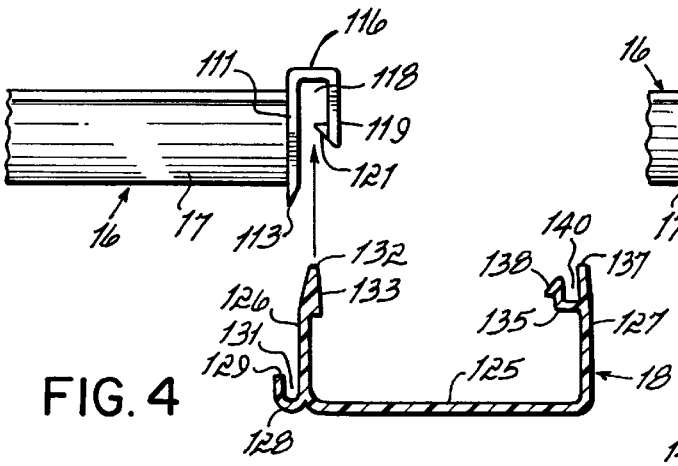
FIG. 4 is a cross-sectional view taken at lines 4—4 of FIG. 1.

As the first and second slatted portions 15, 16 are identical, only slatted portion 15 is described with, again, like numerals used on slatted portion 16 as shown in FIGS. 1 and 4. The slatted portion 15 includes a right side wall 111 and a left side wall 112 with a series of slats 17 running between the right and left side walls (FIGS. 1 and 4). Separating the individual slats are notches 114 with score lines 115 extended down along the right and left side walls. Extended from the side walls 111 and 112, are L-shaped extensions 116. There is one extension from each of the side walls along each of the slats with a space 117 between the adjacent L-shaped extensions. These L-shaped extensions form a channel 118 between the respective side walls and outer leg 119. The outer leg 119 further includes an inwardly projected detent 121 which points towards the inner walls 111 or 112 respectively.

Holding the sections together are right and left rails 18 and 19. Again, these are mirror images of each other and only right rail 18 is described in detail with corresponding numbers used on the right and left sides. The rails include a top surface 125, an inner wall 126 and an outer wall 127 as shown in FIGS. 1–5. The upper edge of inner wall 126 includes an inner arcuate lip or extension 128 having a terminal edge 129. This forms a channel 131 between the edge 129 and the inner wall 126. The bottom edge 132 of inner wall 126 further includes a tapered projection 133.

The outer wall 127 of the rails includes an inverted L-shaped projection 135 having a bottom edge 136. Projection 135 does not extend as far from top wall 125 as does side wall 127. This provides a gap between edge 136 and edge 137. The gap should be roughly equal to the thickness of the respective flanges in the top, bottom and middle sections. The L-shaped projection 135 further includes an inward tapered projection 138. Between the L-shaped projection 135 and the outer wall 127 is channel 140.

As shown in FIG. 1, these individual pieces or members are assembled to form a shutter which can be mounted to the side wall of a building. The initial step in assembling the shutter is of course to establish the appropriate size by removing individual slats 17 from the upper and lower slatted sections 15 and 16. The slats 17 are separated by cutting the sides of slats 17 along the score lines 115 starting from the notches 114 and extending all the way down. The spaces 117 between the L-shaped extension 116 facilitate the separation of individual slats.

Once the size of slatted portions 15 and 16 are established, the rails 18 and 19 are cut with a miter saw to the desired size so that they will extend from the inner surface 141 of bottom wall 106 of the bottom portion 13 up to the inner surface 142 of the top surface 24 of top portion 12.

Figure 3:
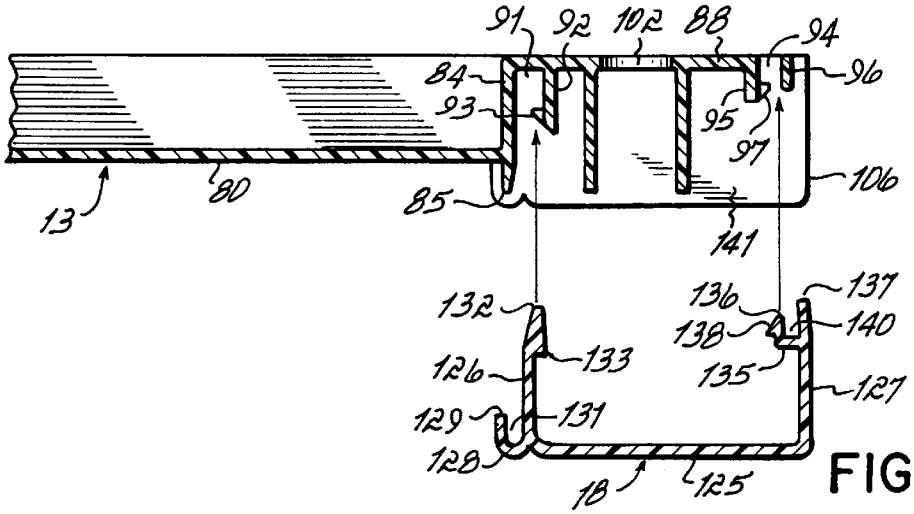
FIG. 3 is a cross-sectional view taken at lines 3—3 of FIG. 1.
Figure 3A:
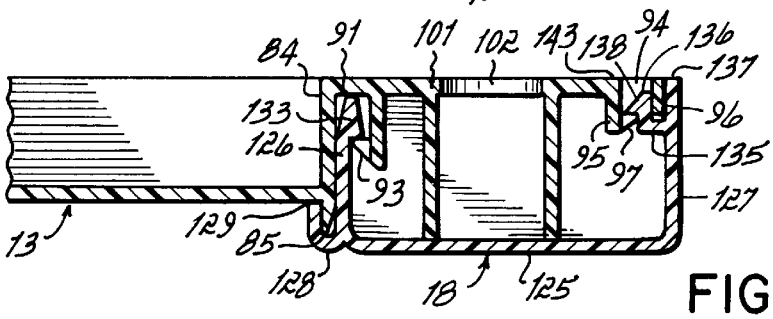
FIG. 3A is a cross-sectional view similar to FIG. 3 with the pieces in an assembled configuration.

The rails 18 and 19 are then snapped into the channels formed by the respective members to hold everything in position starting from the bottom. As depicted in FIGS. 1, 3 and 3A, the bottom edge 132 of the inner wall 126 of the rail 18 is inserted into the channel 91 and further the L-shaped projection 135 is inserted into the outer channel 94. The projection 133 snap fits and is held into position by detents 93. The serration on detents 93 are designed to prevent the rail from slipping out of the channel. Likewise, the tab 138 on the bottom edge 136 of the L-shaped projection will insert within the outer channel 94 with the tab 138 engaging the serrated teeth 97. The bottom edge 137 of outer wall 127 of rail 18 extends over the outer strip 96 and rests along the back side 143 of the bottom part 13. The upper edge 85 of wall 25 rests in the arcuate member 128.

Figure 4A:
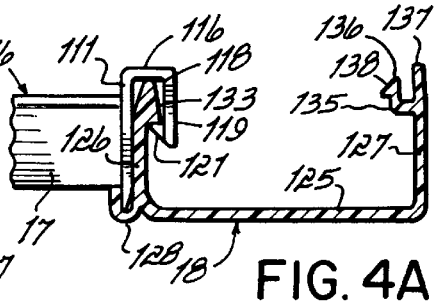
FIG. 4A is a cross-sectional view showing the same view as FIG. 4 with the pieces in an assembled configuration.
Figure 5:
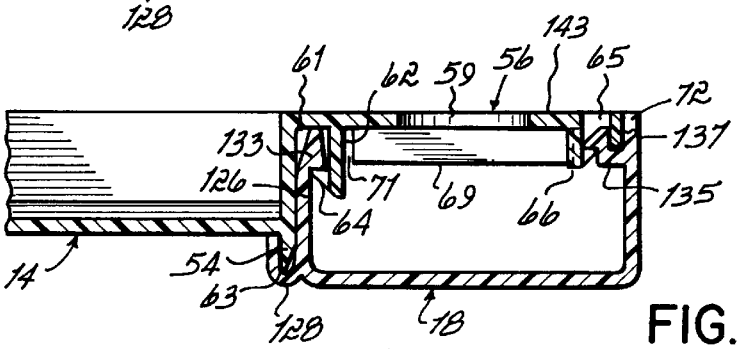
FIG. 5 is a cross-sectional view taken at line 5—5 of FIG. 2 of the middle portion and side rail.

Next, the rail 18 is snap fitted into the middle slatted section 16 with the inner wall 126 fitting into the channel 118 formed by the L-shaped extensions 116 (FIG. 4 and 4A). Again, the tapered projection 133 will engage the detents 121 from the L-shaped projections holding the rail to the slatted sections. Further the arcuate portion 128 of the rail will extend up and over the upper edge 113 of the side wall 111 of the slatted portion 17.

The middle section 14 is then snap fitted onto the rail 18. Again, the inner wall 126 will snap into the channel 61 with the bottom edge of inner wall 126 extended through opening 71. The outer wall 127 extends over the edge of second strip 67 with the inner L-shaped projection 135 extended into the channel 65. The L-shaped projection extends through opening 72.

Slatted portion 15 is then snap fitted into position in the same manner as slatted portion 16. Finally, the top portion 12 is snap fitted into position in the same manner discussed with respect to the bottom portion 13. This is repeated with rail 19. The toothed detents 93, 97, 34 and 38 lock onto the inner edge of the rail so as to prevent the top and bottom portion of the shutter from sliding. This eliminates the need for a separate fastener. Further the forward edge 144 of top walls 24*a* and 24*b* and forward edge 147 of bottom wall 106 are tapered from 5 to 60° preferably 45°. This makes the transition from the back to the top and bottom walls less noticeable.

The shutters can be attached to a wall by simply screwing through the rail portions 18 and 19, through the flange portions into the wall. The mounting screws would be exposed. Due to the configuration of the flanges and ribs, the pressure exerted by the individual screws would not cause the rail members to spread outwardly. The rails would maintain the appearance of a rigid piece of wood. Alternately, screws can be partially inserted into the wall at locations corresponding to the keyholes 30, 59 and 102 in the flanges. Tick marks 145 are located on the top and bottom walls to assist in proper location of the screws. The head of the screw is spaced from the wall a distance slightly greater than the thickness of the flanges. The shutter is placed over the screw heads so that the screw heads extend through the enlarged portions of the keyholes and the shutter pushed down so that the small portion of the keyhole rests on the shank of the screw with the head holding the shutter in position. As indicated, the detents 105 in the keyholes 102 in the bottom portion 13 will prevent the shutter from rising, permitting the shutter to separate from the screws.

The shutters of the present invention provide a variety of different features. Of course, ease of adjusting the height is very important. The configuration of the slatted section allows for very precise adjustment of the height so that the entire shutter is correctly adjusted. Further, the flanges in the top, middle and bottom section keep the rail section from spreading outwardly when assembled and makes the shutter appear to be made from wood. Further, the way the rails attach to the individual sections, particularly the inner walls of the rails, snap fitting into the channel formed along the walls of the respective portions, makes it very easy to assemble because it does not require sliding the individual sections along the channel to assemble the shutter. Further, separated fasteners are not required to hold the section of the shutter together.

Thus, the present invention provides a variety of different advantages providing an improved aesthetic appearance and improved ease of assembly and mounting. This has been a description of the present invention along with the preferred method of practicing the present invention known to the inventor, however, the invention itself should be defined only by the appended claims wherein we claim:

1. A shutter assembly comprising a top member, a bottom member, a first slatted portion, a first and second side rails, wherein said top member includes a body portion, a first and second top side walls;

a first top flange extended from said first top side wall to said body portion, a second top flange extended from second top side wall to said body portion, each of said top flanges having inner and outer channels;

said bottom member further including first and second bottom side walls, and first and second bottom flanges extended from said bottom side walls, each of said bottom flanges including inner and outer channels;

said slatted portion having a first and second lateral sides and a channel extended outwardly from each of said sides;

wherein each of said rails include an inner wall and an outer wall, said inner walls adapted to fit into and engage said inner channels of said top and bottom flanges and snap fit into said channels of said slatted portion;

wherein said outer walls of said rails include a portion adapted to fit within and engage said respective outer channels of said flanges of said top and bottom members.

2. The shutter assembly claimed in claim 1, wherein said side walls of said top and bottom member each include ridges, wherein said side rails further include upper arcuate edge portions adapted to enclose said ridges of said side walls of said top and bottom members.

3. The assembly claimed in claim 1 wherein said inner wall of said rail has a projection adapted to snap fit against inwardly extended detents in said inner channels.

4. The assembly claimed in claim 1 wherein said outer wall of said rails includes a L-shaped leg member, said L-shaped leg member adapted to fit within said outer channels, said leg portion having an extension adapted to snap fit against detents in said outer channels.

5. The assembly claimed in claim 1 wherein said flanges each include a keyhole shaped mounting hole.

6. The assembly claimed in claim 5 wherein at least one of said keyholes includes a barb separating a wide portion of said hole from a narrow portion of said hole and adapted to maintain said shutter mounted to a wall.

7. The assembly claimed in claim 3 wherein said detents are toothed detents.

8. The assembly claimed in claim 1 wherein said slatted portion includes a plurality of slats, said slats are separated from each other by cut lines.

9. The assembly claimed in claim 1 wherein said channels of said slatted portion are formed from a plurality of L-shaped members extended from each side of each slatted portions, wherein said L-shaped members are separated from adjacent L-shaped members.

10. The shutter assembly claimed in claim 1 wherein said forward edges are tapered at about a 45° angle.

11. A shutter assembly comprising a shutter body;

a first side rail;

a second side rail, said shutter body having a first side and a second side, said first and second sides each having upper and lower edges and a channel formed along each said lower edge;

said side rails having inner and outer side walls;

each inner side wall of said rails including a lip portion extending up and away from said side wall and lower edges adapted to rest within said channels of said shutter body, with said lips extended over said upper edges of said respective sides of said shutter body, wherein each of said lips form a channel and upper edges of said side walls of said body rest in said channels.

12. The shutter assembly claimed in claim 11, said lower edges of said inner walls of said rails each include a projection wherein said channel of said shutter body including a plurality of detents wherein said projection engages said detents when said edge rests in said channel.

13. A shutter assembly comprising a top member, a bottom member, a first and second side rails and a slatted portion between said top member and bottom member;

said top member, bottom member and slatted portions each having right and left upwardly opened channels along right and left sidewalls thereof;

said channels each having a detent adapted to engage portions of said side rails;

said rails having inner walls positioned in said channels holding said top, bottom and slatted portion together;

wherein said slatted portion comprises a plurality of individual slats connected together along said side walls;

wherein said channels in said slatted portion are formed from spaced individual L-shaped projections extended from side walls of said slatted portion.

14. The shutter assembly claimed in claim 13 wherein said side walls of said slatted portion include an upper edge and a plurality of notches in said upper edges between adjacent slats.

15. The shutter assembly claimed in claim 14 further including a plurality of score lines in said side walls of said slatted portion positioned between adjacent slats and wherein said L-shaped projections are separated by spaces aligned with said score lines.

16. A flange adapted to be mounted to a wall, said flange having a hole adapted to receive a headed fastener, said hole has a lower large section sized to permit a head of said fastener to pass therethrough;

said hole having an upper small portion sized to permit a shank of said headed fastener to pass therethrough but not allow said head to pass therethrough;

a tapered projection adapted to prevent the shank of said fastener from moving from said small portion to said large portion, said projection having a tapered section directed toward said large portion and a stop section directed toward said small section.

17. A shutter assembly comprising a shutter body;

a first rail;

a second rail;

said shutter body having a first side and a second side, said first and second sides each having upper and lower edges and a channel formed along each said lower edge;

said side rails having inner and outer walls;

each inner side wall of said rails including a bottom edge adapted to snap fit within said channels of said shutter body.

18. The shutter assembly claimed in claim 17 wherein each of said inner side walls of said rails include a lip portion which extends up and over said upper edges of said upper edges of said first and second sides.

19. A shutter assembly comprising a top member, a bottom member, a first slatted portion, first and second side rails;

wherein said top member includes a first and second top side wall;

wherein said rails attach to said top member, bottom member and slatted portion holding them in an assembled configuration with upper edges of said rails abutting against said first and second top side walls respectively;

wherein said top side walls include a forwardmost edge adjacent front walls of said side rails;

wherein said forward edges are tapered from about 5 to about 60°.

* * * * *